United States Patent [19]

Kanamaru et al.

[11] Patent Number: 4,756,236

[45] Date of Patent: Jul. 12, 1988

[54] GAS COMPRESSOR

[75] Inventors: Hisanobu Kanamaru, Katsuta; Masaharu Okazaki, Kanasago; Kazushi Sasaya, Katsuta, all of Japan

[73] Assignee: Hitachi, Ltd., Tokyo, Japan

[21] Appl. No.: 2,287

[22] Filed: Jan. 12, 1987

[30] Foreign Application Priority Data

Jan. 13, 1986 [JP] Japan ..... 61-3448
Jan. 22, 1986 [JP] Japan ..... 61-10186

[51] Int. Cl.[4] ..... F01B 13/04
[52] U.S. Cl. ..... 91/487; 91/506
[58] Field of Search ..... 417/269; 91/485, 486, 91/487, 507, 499

[56] References Cited

U.S. PATENT DOCUMENTS

| | | | |
|---|---|---|---|
| 3,096,723 | 12/1963 | Puryear | 91/485 |
| 3,656,299 | 4/1972 | Fleury | 91/499 |
| 3,910,587 | 10/1975 | Loeffler | 277/74 |
| 4,644,850 | 2/1987 | Kanamaru | 91/499 |

FOREIGN PATENT DOCUMENTS

| | | | |
|---|---|---|---|
| 155487 | 9/1985 | European Pat. Off. | 91/499 |
| 1127830 | 4/1962 | Fed. Rep. of Germany | 91/507 |
| 1024850 | 4/1966 | United Kingdom | 91/507 |
| 922308 | 4/1982 | U.S.S.R. | 91/499 |

*Primary Examiner*—William L. Freeh
*Attorney, Agent, or Firm*—Antonelli, Terry & Wands

[57] ABSTRACT

A gas compressor has a cup-like casing. A driving shaft is rotatably carried by a bottom of the casing and has a rotary plate secured thereto. A driven shaft is disposed in the casing at an inclination angle of 20° against the driving shaft, supported by a bearing provided on an end of the driving shaft, and driven by the driving shaft. A cylinder block is fixed to the driven shaft and has a cylinder bores receiving pistons coupled with the rotary plate so that the pistons reciprocate in the cylinder bores upon rotation of the driving shaft. A side plate is secured to an open end of said casing and has a bore receiving a bearing for supporting one end of the driven shaft. The bore is formed in the inside the side plate which projects outside, so that a distance between the bearing of the driving shaft and the bearing in the bore is extended and stable.

3 Claims, 4 Drawing Sheets

$\ell_0$
3
17
$P_1$
16
$\ell_1$
$P_0$
13
1
4
$\theta$

211

VII
214
213
21
211
215
VII

GAS COMPRESSOR

BACKGROUND OF THE INVENTION

The present invention relates to a gas compressor and, more particularly, to a gas compressor which has a rotary cylinder block with cylinder bores and pistons reciprocating in the cylinder bores upon rotation of the cylinder stock and which can be suitably mounted to a car.

A typical conventional gas compressor which is provided with cylinders and pistons adapted to reciprocate in the cylinders by converting rotation of a driving shaft into axial motion is disclosed in Japanese patent Laid-Open No. 91383/1983. This gas compressor comprises a rotary swash plate secured to the driving shaft and an oscillation disk disposed on a driven shaft end and oscillatorily driven by the rotary swash plate. The rotary swash plate has a portion inclined with respect to the driving shaft, so that unbalanced force is apt to be caused on the driving shaft by the rotation of the rotary swash plate. The rotary swash plate suffers from various frictions caused between the rotary swash plate and the oscillation disk by oscillation of the oscillation disk and rotation of the rotary swash plate. This construction of the gas compressor makes vibrations and noises. Further, the gas compressor requires a complicated construction because of the necessity of many parts.

The Japanese patent Laid-Open, further, discloses an improved gas compressor. However, the gas compressor has many defects left thereon.

SUMMARY OF THE INVENTION

An object of the present invention is to provide a highly reliable gas compressor with reduced mechanical friction and less parts.

Another object of the present invention is to provide a highly reliable gas compressor with less parts and with reduced mechanical friction by reducing the pressure acting upon a driven shaft.

The present invention is characterized by a first casing defining a working chamber and rotatably carrying a driving shaft, a rotary plate disposed in the working chamber and fixed to the driving shaft so as to rotate in a plane substantially perpendicular to the driving shaft, the rotary plate being coupled with pistons to reciprocate, a second casing fixed to the first casing and having a bearing receiving recess, a high pressure recess and a low pressure recess, a driven shaft fixed to a cylinder block with cylinder bore receiving the pistons, rotatably supported by an end of the driving shaft and a bearing inserted in the bearing receiving recess at an inclination angle with respect to the driving shaft, and engaged with the driving shaft to be rotated, and a float valve plate disposed between the cylinder block and the second casing so as to form cylinder heads of the cylinder bores.

In this gas compressor, discharge pressure of the compressed gas acts on a float valve plate which presses, in turn, the cylinder block end at about a cylinder bore center, so that a rotating moment is applied on the driven shaft. The rotating moment induces a load on the bearing in the bearing receiving recess of the second casing. The load becomes smaller as the distance between the supporting bearings of the driven shaft is lengthened. In this invention, since the bearing is disposed in the recess formed in the second casing, the above-mentioned distance between the two bearings is lengthened, as a result, the load is reduced.

The end of the driving shaft is provided with the bearing for supporting the driven shaft. The bearing receives a resultant force from the cylinder block pressing force and the above-mentioned load, and the direction that the resultant force acts on the bearing approaches more the axis of the driving shaft as the load become smaller. In the present invention, the load is smaller so that the direction that the resultant force acts on the bearing of the driving shaft approaches more the axis of the driving shaft, and never go beyond 30° against the axis of the driving shaft. Therefore, the gas compressor is highly reliable.

Other advantages are described referring to the accompanying drawings.

DESCRIPTION OF A PREFERRED EMBODIMENT

The present invention will be described hereunder, referring to a preferred embodiment thereof shown in the accompanying drawings.

Figure 1:
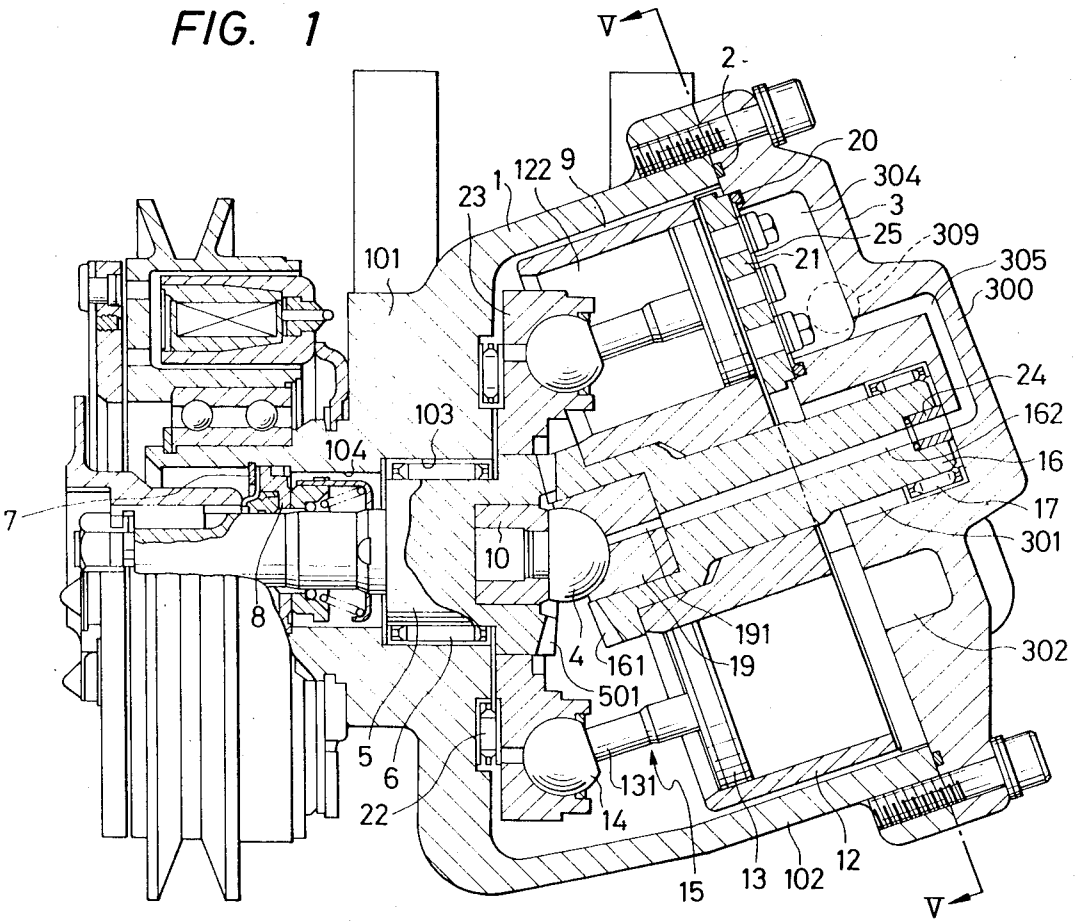
FIG. 1 is a sectional view of a gas compressor for a car according to an embodiment of the present invention.

In FIG. 1 showing a sectional view of a gas compressor, a cup-like casing 1 as a first casing comprises a bottom 101 and a cylindrical side wall 102 extending sideways from the bottom 101 at about 110° with respect to an inner surface of the bottom 101 to form a working chamber 9 therein. At a central portion of the bottom 101 of the casing 1, a bore is formed. A part 103 of the bore receives a radial bearing 6.

A driving shaft 5 passes through the bottom 101 and is rotatably supported by the bearing 6. A mechanical sealing 8 is disposed between the inner surface of the bore 104 and the driving shaft 5 and fixed by a snap ring 7. The shaft 5 is driven by a driving mechanism disposed outside the cup-like casing 1 and connected to an outer end thereof. An inner end of the driving shaft 5 is provided with a rotary plate 23 at right angles against the axis of the driving shaft. At a central portion of the inner end of the driving shaft 5, a semispherical ball 4 as a bearing is secured to the driving shaft 5 through a bushing 10.

A helical bevel gear 501 is formed at the inner end around the semispherical ball 4.

Figure 2:
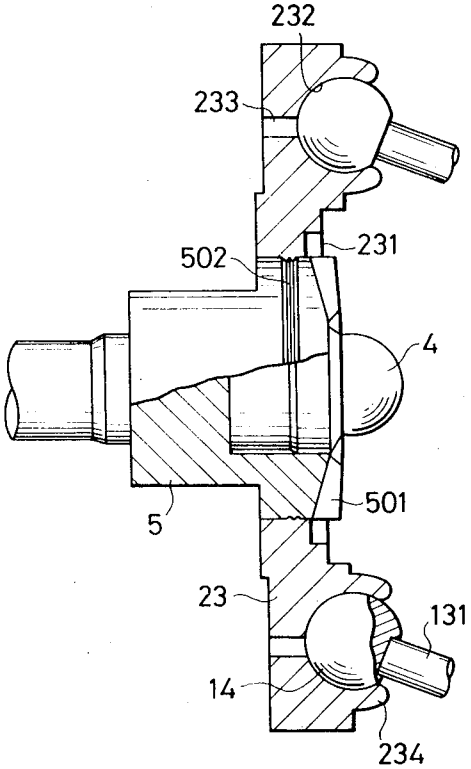
FIG. 2 is a sectional view of an assembly of a driving shaft and a rotary plate.

The rotary plate 23, the back surface of which is supported at the casing 1 by thrust bearings 22, is fixed on the outer surface of the driving shaft 5. An aluminum alloy or the like is used for the rotary plate 23. As shown in FIG. 2, after the center portion is fitted to the driving shaft 5, the portion 231 near the center of the rotary plate 23 is pressed locally and vertically so that part of the material is plastically fluidized and caused to flow into a ring-like groove 502 that is formed in advance in the driving shaft 5, and both of these members are mechanically coupled by the pressing force occurring around the ring-like groove 502. In a front surface of the rotary plate 23, a plurality of spherically recessed bearing surfaces 232 are formed. The bearing surfaces 232 fluidly communicate with the back surface of the rotary plate 23 through lubrication oil passages 233.

Figure 3:
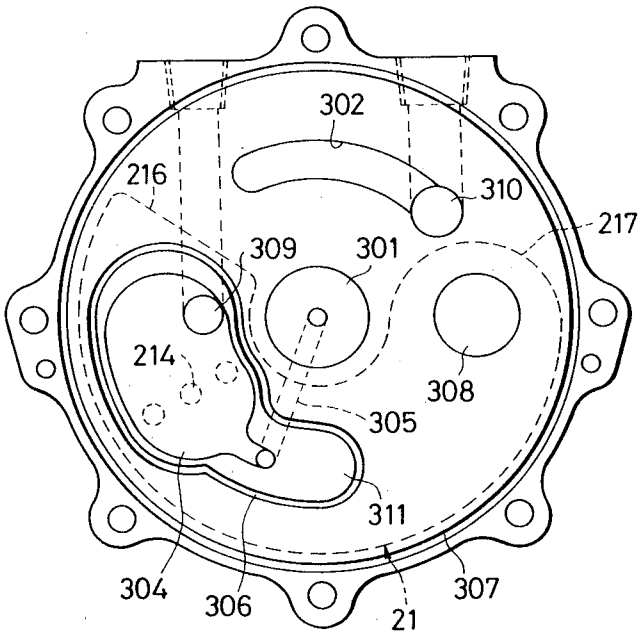
FIG. 3 is a side view of a side plate.

Referring back to FIG. 1, a side plate 3 as a second casing is airtightly secured to the cup-like casing 1 through an O-ring 2 by means of screws so as to close the working chamber 9. The side plate 3 has a projection 300 projecting outside at the central portion. As shown in FIG. 3, in the inside of the side plate 3, a bearing receiving recess 301 is formed at a central portion. A high pressure recess 304 and a low pressure recess 302 each are formed around the bearing receiving bore 301 and communicate with a high pressure port 309 and a low pressure port 310, respectively. The high pressure recess 304 communicates with the bearing receiving recess 301 through a oil passage 305. A groove 306 for receiving a seal ring 20 is formed around the high pressure recess 304. Further, a groove 307 is formed around the periphery of the side plate 3 and receives the O-ring 2 (as shown in FIG. 1).

Figure 4:
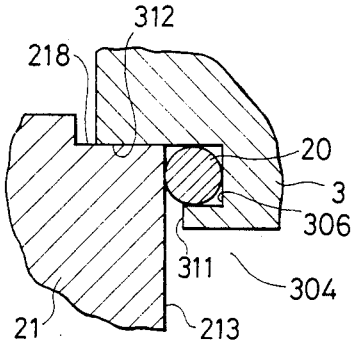
FIG. 4 is an enlarged sectional view of a part of FIG. 1 showing a sealing between the side plate and a float valve plate.

An area enclosed by the groove 306 for the seal ring 20 defines a high pressure chamber when closed by a float valve plate 21 which is described later. As shown in FIG. 4, the groove 306 is formed in a little recessed portion 311 which defines the high pressure chamber so that a guide side wall 312 is formed outside the groove 306.

Referring to FIG. 1, the bearing receiving bore 301 has a radial bearing 17 fitted therein. The depth of the bearing receiving bore 301 is twice the bearing width.

A driven shaft 16 has a semispherical bearing 19 secured to an end thereof. A helical bevel gear 161 is formed in the driven shaft 16 around the bearing 19. The driven shaft 16 has an oil passage 162 axially formed over the whole length thereof. The driven shaft 16 is inserted in the working chamber 9 and supported at both ends by the semispherical bearing 4 and the radial bearing 17 so as to incline at an angle of 20° with respect to the driving shaft 5. The helical bevel gear 161 of the driven shaft 16 is meshed with the helical bevel gear 501 formed in the driving shaft 5, whereby the rotation of the driving shaft 5 is transferred to the driven shaft 16.

Figure 5:
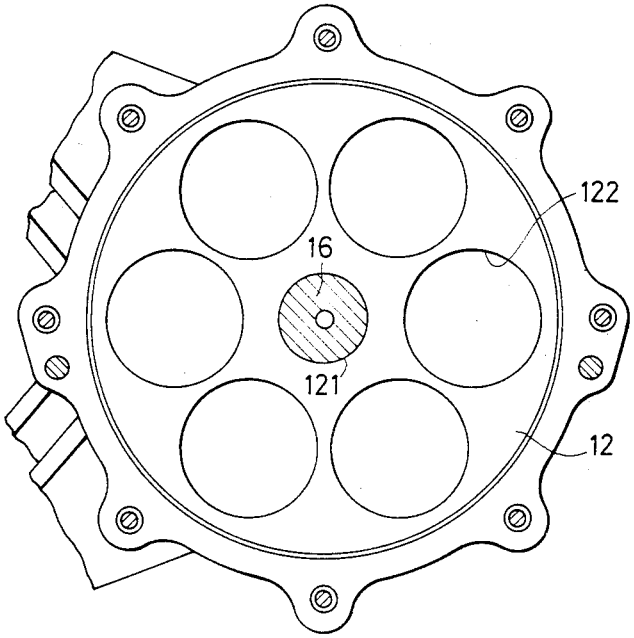
FIG. 5 is a sectional view of the gas compressor taken along a line V—V of FIG. 1.

A cylinder block 12 is made of a light alloy such as aluminum alloy and has a mounting hole 121 at its center and a plurality of cylinder bores 122 of through holes arranged equiangularly as shown in FIG. 5. The cylinder block 12 is mounted on the driven shaft 16 not to be moved relatively, and disposed in the working chamber 9 of the cup-like casing 1.

A plurality of piston devices 15, as shown in FIG. 1, each have a piston 13 slidablely inserted in the cylinder bore 122, a piston rod 131 and a steel ball 14. The piston 13 and the piston rod 131 are formed integrally from an aluminum alloy to reduce the weight. The rod 131 is inserted in a hole of the steel ball 14 and secured to the steel ball 14 by plastic deformation of the rod member as shown FIG. 2. The steel ball 14 of the piston device 15 is rotatably fitted into the recessed bearing surface 232, and an open end portion 234 of the recessed bearing surface 232 is pinched thereby to prevent the steel ball 14 from coming off therefrom by a champing force.

Figure 7:
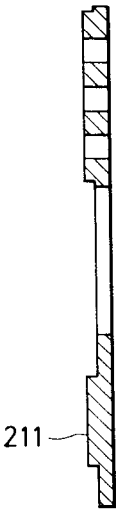
FIG. 7 is a sectional view of the float valve plate taken along a line VII—VII of FIG. 6.
Figure 6:
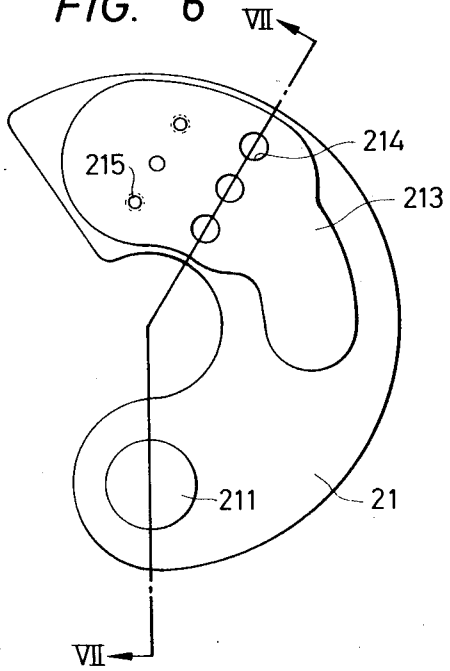
FIG. 6 is a plane view of the float valve plate used in the gas compressor.

The float valve plate 21 with check valves 25, constituting cylinder heads is disposed between the end of the cylinder block 12 and the inside of the side plate 3 with a small gap between the side wall 102 of the casing 1 and the periphery of the float valve plate 21. The float valve plate 21 is constructed as shown in FIGS. 6 and 7. Generally speaking, the float valve plate 21 has a horseshoe-like shape and it is made of steel plate. The float valve plate 21 has two projections 211 and 213 which project a little from the surface surrounding the projections. The projection 211 is for positioning and guiding itself and inserted into a guide recess 308 made in the side plate 3. The projection 213 is movably fitted in the guide side wall 312 formed around the seal ring groove 306 of the side plate 3 so as to cover the high pressure chamber 311 including the high pressure recess 304. The projection 213 of the float valve plate 21 has valve holes 214 and screw holes 215. The valve 25 is mounted by screws screwed in the screw holes 215 to cover the valve holes 214. The float valve plate 21 is mounted on the side plate 3 as shown in FIG. 4. The projection 213 is inserted in the recessed portion 311 of the side plate 3, guided by the guide side wall 312 of the recessed portion 311 and the guide recess 308, and abutted on the seal ring 20 to define the high pressure chamber as previously mentioned. The float valve plate 21 is moved vertically to the float valve plate surface by the high pressure applied on the float valve plate 21.

Even if the above-mentioned float valve plate 21 is shifted by the pressure applied on the valve plate 21 to the cylinder block side, the seal ring 20 is prevented from going out from the seal ring groove 306 because the projection 213 of the float valve plate 21 is guided by the guide side wall 312 of the side plate 3, and the overlapping relation between the guide side wall 312 of the side plate 3 and the projection side wall 218 of the float valve plate 21 is kept. Therefore, the durability of the seal ring 20 can be extended greatly and the seal ring 20 has a stable sealing function. The gas compressor having such a seal mechanism is enhanced greatly in reliability.

A low pressure area is outside the high pressure chamber enclosed by the seal ring groove 306 and communicates with the low pressure recess 302 communicating with a low pressure port 310.

Further, a through-hole 191 formed in the semispherical bearing 19 is communicated with the passage 305 formed in the side plate 3 through the passage 162 formed in the driven shaft 16, thereby forming an oil supply passage led to the bearings 4, 19. A bushing 24 is disposed between the driven shaft 16 and the bottom of the bearing receiving recess 301 of the side plate 3 in order to damp the thrust force and to distribute the lubricant.

In the arrangement described above, as the driving shaft 5 is rotated by, for example, an internal combustion engine, the rotary plate 23 is rotated in synchronism with the driving shaft 5, followed by rotation of the driven side of the helical bevel gears 501, 161, that is, the driven shaft 16 and the cylinder block 12.

When the cylinder block 12 and the rotary plate 23 rotate synchronously clockwise, for example, as shown in FIG. 3, one of the cylinder bores 122 reaches the leading edge 217 of the float valve plate 21. Upon a further small amount rotation, the cylinder bore 122 is closed by the float valve plate 21 and the piston in the bore 122 starts a compression stroke. When the cylinder bore 122 further rotates and reaches the valve holes 214, the compressed gas starts to discharge through the valve holes 214. When the cylinder bore 122 goes beyond the trailing edge 216 of the float valve plate 21 after the cylinder bore leaves the valve hole 214, the cylinder bore 122 closed by the float valve plate 21 starts to open and to suck a gas from the low pressure area. The cylinder block 12 further rotates and the cylinder block 122 go beyond the leading edge 217 of the float valve plate 21, and when it is closed by the float valve plate 21 as mentioned above, the gas in the cylinder bore starts to be compressed. Thus, the piston 13 in the cylinder bore 12 is in the compression stroke when the cylinder bore 12 is closed by the float valve plate 21, and when the cylinder bore 12 is opened, the piston 13 is in the suction stroke. Thus, the gas is sucked, compressed and discharged according to the rotation of the cylinder block 12.

Next, when the high pressure recess 304 attains the high pressure, the high pressure is applied on the float valve 21 enclosed by the seal ring 20 so that the float valve 21 is pushed to the end surface of the cylinder block 12 and seals by itself airtightly the cylinder bore 122. Accordingly, so long as the high pressure recess 304 is at the high pressure, the float valve 21 is pushed always to the cylinder block 12 and air-tightness is always kept stably by its own force with the cylinder block 12. As described above, since sealing is made by the own force of the float valve plate, there is no need to separately dispose any push means and this arrangement is extremely simple and has high reliability and producibility.

The float valve plate 21 is enough if it is sufficient disposed only on the high pressure side, so that the depicted float valve has the horseshoe like shape, as in the embodiment, the dimension of which is a little larger than the area enclosed by the seal ring 20. However, a round shape may be used for the horseshoe.

When the float valve plate 21 is used for only the high pressure side, its weight is reduced. And the sealing performance can be further improved.

In the normal operation state of a gas compressor used in a car air cooler, the cooling medium and the lubricant are mixed and compressed. Therefore, when the high pressure is established in the high pressure chamber, the lubricant is simultaneously supplied to the semispherical bearing 19 through the oil supply passages. The oil jetted from the bushing 24 lubricates the bearing 17, too, and lubrication can be kept smoothly by itself. Since this oil supply passage is formed inside the originally necessary components, it can be formed simply without any trouble and its appearance is also good.

Figure 8:
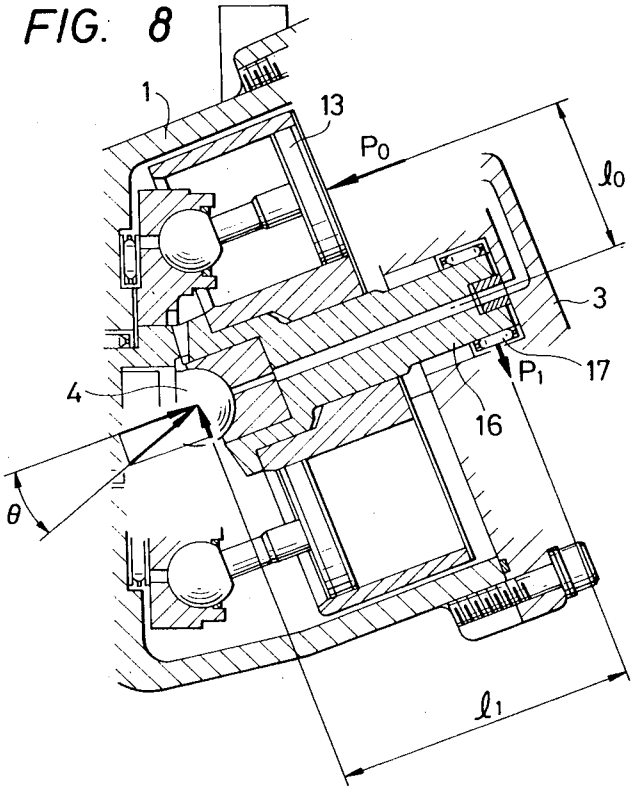
FIG. 8 is a sectional view of the gas compressor for explaining forces applied on bearings.

Next, in the construction in which the driven shaft 16 which is fixed to the cylinder block is extended up to the inside of the side plate 3 and supported rotatably through the bearing 17, forces acting on the bearings 417 will be explained with reference to FIG. 8.

When a high discharge pressure is applied on the float valve plate 21, the float valve plate 21 presses the cylinder block 12 by force $P_0$. The force $P_0$ produces a moment in the cylinder block 12 and the driven shaft 16.

Considering equilibrium of the moment at the center of the semispherical ball 4 the following equation is established to keep a fixed position of the cylinder block 12:

$$P_0 \cdot l_0 = P_1 \cdot l_1,$$

wherein $P_0$: force acting on the cylinder block 12, caused by discharge pressure (kgf)

$l_0$: distance between the central axis of the driven shaft 16 and the central axis of the cylinder bore 122 (mm)

$P_1$: force acting upon the bearing 17 (kgf)

$l_1$: distance from the center of the semispherical ball 4 to the center of the bearing 17 (mm)

$\theta$: direction of resultant force acting upon the semispherical ball 4 (degree).

Therefore, the force $P_1$ acting upon the bearing is:

$$P_1 = \frac{l_o}{l_1} \cdot P_o$$

If $l_1 = 70$ mm, $P_0 = 627$ kgf, and $l_0 = 35$ mm, $$P_1 = \frac{35}{70} \times 627 = 313.5 \text{ kgf}$$

The direction of resultant force ($\theta$) is $$\theta = \tan^{-1} \frac{P_1}{P_o} = \frac{l_o}{l_1}$$

$$= \tan^{-1} \frac{35}{70} = 26.6°$$

Accordingly, in comparison with a construction in which a fixed shaft is disposed on the side plate and a cylinder block is supported rotatably by the fixed shaft within the cylinder block through a bearing, the force acting upon the bearing and the direction of the resultant force are reduced by 50% for $P_1$ and by 40% for $\theta$, respectively.

The direction of resultant force $\theta$ is necessary to be at most 30°. Namely, the bearing 17 is necessary to be spaced from the semispherical ball 4 by more than 1.7 times the distance $l_0$. If it is beyond 30°, a bearing function by the spherical ball 14 is very unstable. The depth of the bearing receiving recess 301 is preferable more than one and half times the width of the bearing 17. As described above, since the force acting upon the bearing and stress acting upon the semispherical ball can be reduced drastically as illustrated in the embodiment described above, there can be obtained a cylinder block rotation type compressor having reduced friction, extended life and high reliability.

What is claimed is:

1. A gas compressor in which pistons are inserted in cylinder through-hole bores formed in a cylinder block so as to reciprocate therein by a reciprocating force thereby providing a compressed gas upon rotation of said driving shaft, comprising a first casing defining a working chamber therein and rotatably carrying said driving shaft;

a rotary plate disposed in said working chamber and secured to said driving shaft so as to rotate in a plane substantially perpendicular to said driving shaft, said rotary plate having a spaced coupling portions circularly arranged equiangularly from each other and coupled with piston rods of said pistons at said coupling portions;

a second casing fixed to said first casing so as to close said working chamber, said second casing having a bearing receiving recess, a high pressure recess, a low pressure recess, and a projection at a central portion on an outside surface thereof, wherein said bearing receiving recess is formed inside said projection of said second casing;

a driven shaft rotatably disposed in said working chamber and radially and axially supported by an end of said driving shaft and a bearing provided within said bearing receiving recess of said second casing so as to have an inclination with respect to said driving shaft at said end thereof so as to rotate according to rotation of said driving shaft, said cylinder block being fixed to said driven shaft such that said cylinder bores are substantially in parallel with said driven shaft, whereby said pistons are reciprocated in said cylinder bores upon the rotation of said driving shaft; and a float valve plate having a valve hole, disposed between said cylinder block and said second casing and constituting cylinder heads of said cylinders in which a gas is subjected to compression, said float valve plate defining a high pressure chamber including said high pressure recess in cooperation with said second casing and being pressed on said cylinder block by a high pressure established in said high pressure chamber through said valve hole, wherein said driving shaft has a semispherical ball bearing at a central portion of said end thereof disposed in said working chamber, said bearing disposed in said bearing receiving recess of said second casing is spaced from the center of said semispherical ball by at least 1.7 times the distance between a central axis of said driven shaft and a central axis of said cylinder bore, and said float valve plate contacts the inside of said second casing through a seal ring disposed around said high pressure recess, thereby providing a high pressure chamber, and the outside of a peripheral portion of said float valve plate communicating with said low pressure recess.

2. A gas compressor according to claim 1, wherein said second casing has a groove formed around said high pressure recess for receiving said seal ring, an outside wall of said groove serving as a guide wall, and said float valve plate has a projection a little projecting, said projection being inserted in said groove and guided by said guide wall so as to sandwich said seal ring.

3. A gas compressor comprising:

a first casing having a bottom and a side wall extending sidewise from one side of said bottom to form a working chamber;

a driving shaft passing through said bottom of said first casing and carried rotatably thereby through a radial bearing, one end of said driving shaft being disposed in said working chamber and having a bearing secured thereon and a bevel gear formed around said bearing;

a rotary plate, disposed in said working chamber, rotatably supported at a back side thereof by said bottom of said first casing through thrust bearings and secured to said driving shaft so as to be substantially perpendicular to said driving shaft, said rotary plate having a plurality of semispherical bearing portions on a front side thereof;

a second casing secured to an open end of said first casing so as to close said working chamber, and having a bearing receiving recess in a central portion of the inside thereof, a high pressure recess communicating with a high pressure port and a low pressure recess communicating with a low pressure port, said second casing having a projection projecting outside and said bearing receiving recess being formed in the inside of said projection, wherein said second casing has a guide wall formed along a groove for said seal ring around said high pressure recess and said float valve plate has a float projection guided by said guide wall of said second casing so that said seal ring is prevented from expanding outside, a driven shaft inclined at a predetermined angle with respect to said driving shaft and radially and axially supported by said bearing of said driving shaft and a bearing disposed in said bearing receiving recess of said second casing, said driven shaft having a bevel gear meshed with said bevel gear of said driving shaft for rotation by the driving shaft;

a cylinder block having a central hole and a plurality of through-hole cylinder bores formed therein equiangularly with each other so as to surround said central hole, said cylinder block receiving said driven shaft through said central hole and secured thereto;

a plurality of pistons inserted in said cylinder bores, respectively, and connected to said rotary plate with piston rods of said pistons being coupled with said bearing portions of said rotary plate; and a float valve plate disposed between said cylinder block and said second casing to close said cylinder bores in which said pistons are in compression stroke, said float valve plate abutting on said second casing through a seal ring arranged around said high pressure recess forming a high pressure chamber communicating with one of said cylinder bores through a valve hole formed in said float valve plate, and being pressed against said cylinder block by a high pressure established in said pressure chamber.

* * * * *